United States Patent [19]

Goff

[11] 4,244,150

[45] Jan. 13, 1981

[54] ONE-PIECE ABRASIVE BLASTING WHEEL

[76] Inventor: James R. Goff, 6601 Shawnee Dr., Oklahoma City, Okla. 73116

[21] Appl. No.: 46,740

[22] Filed: Jun. 8, 1979

[51] Int. Cl.[3] ..... B24C 5/06

[52] U.S. Cl. ..... 51/434; 51/169

[58] Field of Search ..... 51/169, 432, 434; 241/292

[56] References Cited

U.S. PATENT DOCUMENTS

| | | | |
|---|---|---|---|
| 1,130,210 | 3/1915 | Spence | 51/169 |
| 2,135,550 | 11/1938 | Alexander | 51/432 |
| 2,204,610 | 6/1940 | Minich | 51/432 |
| 2,204,611 | 6/1940 | Minich | 51/432 |
| 2,352,588 | 6/1944 | Rosenberger | 51/432 |
| 2,368,664 | 2/1945 | Keefer | 51/169 X |
| 2,958,165 | 11/1960 | Hofman | 51/169 |

FOREIGN PATENT DOCUMENTS

| | | | |
|---|---|---|---|
| 2538228 | 3/1977 | Fed. Rep. of Germany | 51/432 |

*Primary Examiner*—Gary L. Smith

*Attorney, Agent, or Firm*—Beveridge, DeGrandi, Kline & Lunsford

[57] ABSTRACT

A blast wheel for a rotatable centrifugal abrasive blasting device comprises a wheel having a front surface and a rear surface. A plurality of radially extending abrasive throwing blades are substantially equally spaced around the circumference of the front surface of the wheel. A vaned impeller is also on the front surface of the wheel. A ring is rigidly secured to the rear surface of the wheel. The blast wheel is a one-piece casting formed of dissimilar materials, such that the wheel, blades and impeller are formed of an abrasion-resistant material having relatively poor machinability. The ring is formed of a material having good machinability. The blast wheel is useful for projecting an abrasive, such as metal shot, against a surface to be treated.

8 Claims, 3 Drawing Figures

ONE-PIECE ABRASIVE BLASTING WHEEL

BACKGROUND OF THE INVENTION

This invention relates to a blast wheel for use in a rotatable abrading device known as a centrifugal blasting machine or abrasive throwing wheel. More particularly, this invention relates to a blast wheel for propelling abrasive materials at abrading velocities.

In the process of blast cleaning or treating surfaces, such as metal surfaces, with an abrasive grit, shot or sand, the abrasive is propelled by centrifugal force at the surface. This is accomplished by the use of centrifugal blasting machines, which comprise rotors or wheels having a plurality of throwing blades mounted thereon. The blades propel the abrasive against the work surface at very high velocities. Due to the action of the abrasive material on the wheel and the throwing blades, these parts are subject to considerable wear over a period of time. In order to minimize wear, the parts of the machine exposed to the abrasive are generally fabricated from abrasion-resistant alloys or shaped in special configuration to minimize the effects of the abrasive material. Notwithstanding these attempts to minimize wear and extend the life of these machines, periodic removal and replacement of parts is necessary. This results in the loss of valuable operating time.

Another problem associated with centrifugal blasting machines is that the surface of the wheel or rotor, which is opposite the surface on which the blades are mounted, must be finished to close tolerances, such as a few thousandths of an inch. This is because the wheel must be mounted on suitable drive means connected to the shaft of a motor in order to provide movement to the wheel. This is usually accomplished by means of a hub mounted on the motor shaft and bolting of the hub to the finished surface of the blast wheel.

Since the blast wheel is made of an abrasion-resistant material in order to reduce wear caused by exposure to abrasive, it is impractical to machine the rear surface of the blast wheel that is to interface with the hub. Because the material of construction has very good abrasion resistance, it possesses very poor machinability. Therefore, it is necessary to grind the rear surface of the blast wheel, which is a very costly and time-consuming process and not readily adapted to obtaining close tolerances on the finished workpiece.

A third problem encountered with centrifugal blasting machines arises because of the very high speeds at which the blast wheel rotates. Typically, the rotational speed will be between about 1500 and 4000 rpm. It is immediately apparent that the centrifugal wheel must be in dynamic balance in order to prolong its life and prevent damage to the bearings in the drive means to which it is connected.

Thus, there exists a need in the art for a blast wheel for an abrasive blasting machine. The blast wheel should have good resistance to wear caused by exposure to abrasive. The wheel should have readily replaceable parts, especially easily replaceable throwing blades. The blast wheel should also have a surface that can be readily finished in order to interface with a coupling or hub connected to drive means. Furthermore, the blast wheel should be capable of being easily balanced to ensure safe and efficient operation at high rotational speeds in the abrasive blasting machine.

SUMMARY OF THE INVENTION

Accordingly, this invention aids in fulfilling these needs in the art by providing a blast wheel for a rotatable, centrifugal abrasive blasting device comprising a wheel having a front surface and a rear surface. A plurality of radially extending abrasive throwing blades are substantially equally spaced around the circumference of the front surface of the wheel. A vaned impeller is also on the front surface of the wheel. A ring is rigidly secured to the rear surface of the wheel. The blast wheel is a one-piece casting formed of dissimilar materials, such that the wheel, blades and impeller are formed of an abrasion-resistant material having relatively poor machinability. The ring is formed of a material having good machinability.

The surfaces of the blast wheel exposed to abrasive are abrasion-resistant thereby minimizing wear. The relatively soft ring on the rear of the wheel makes it possible to machine the rear surface of the wheel to close tolerances using conventional cutting tools to interface with a coupling or hub connected to drive means, such as the drive shaft or an electric motor. The ring also makes it possible to easily balance the blast wheel by removing plugs of the relatively soft material, such as by drilling holes in the ring.

BRIEF DESCRIPTION OF THE DRAWINGS

This invention will be more fully understood from the detailed description that follows, and by reference to the accompanying drawings, which depict an abrasive blast wheel and detailed views of the various parts of the wheel according to this invention. In the drawings.

DETAILED DESCRIPTION

Figure 1:
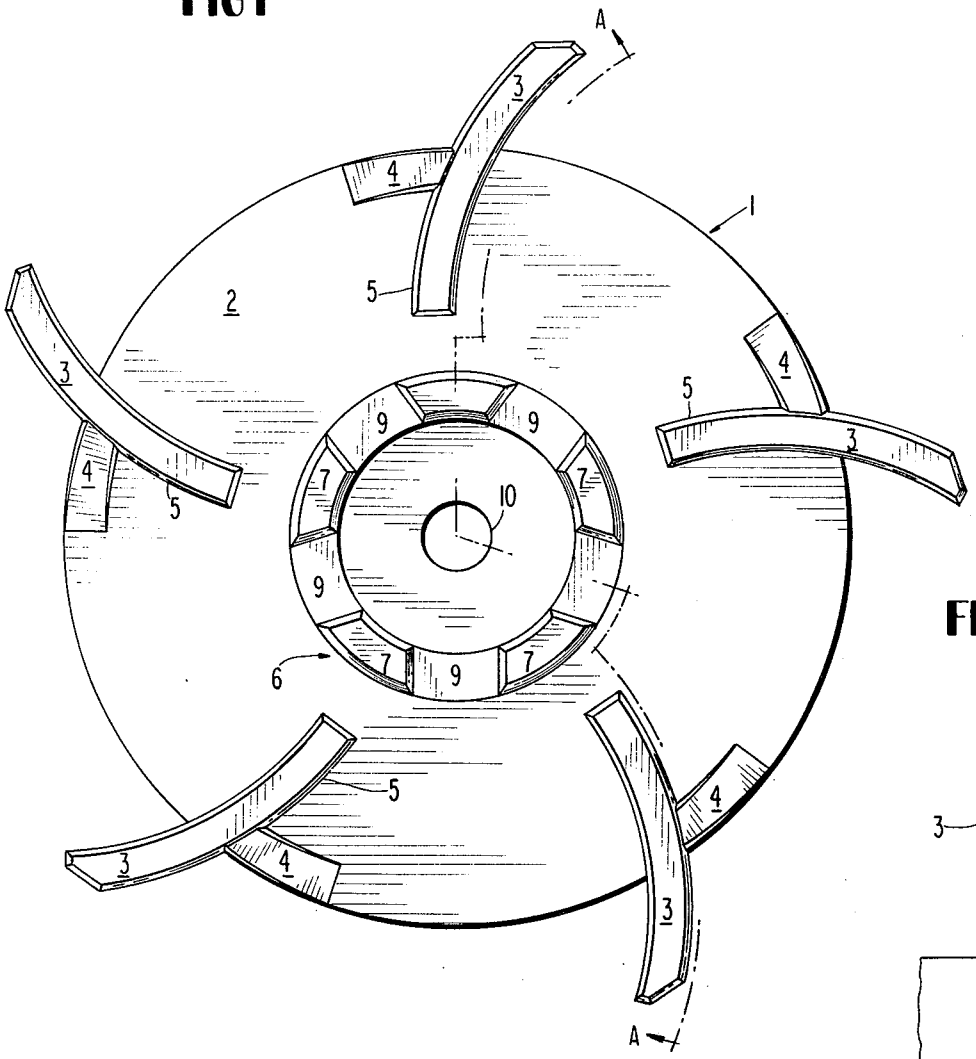
FIG. 1 is a plan view of an abrasive blast wheel according to the invention.

Referring to FIG. 1, there is depicted a circular wheel or disc generally designated as 1. On the surface 2 of wheel 1, are five throwing blades 3, substantially equally spaced around the circumference of the wheel. Each of the blades 3 extends radially outwardly from the center of the wheel.

Wheel 1, as shown in FIG. 1, is adapted for rotation in a clockwise direction. Each of the blades 3 shown in FIG. 1 is curved in the direction of rotation. It will be understood that other blade configurations can be employed. For example, the blades can be substantially straight or have a different curvature than that exemplified.

Figure 2:
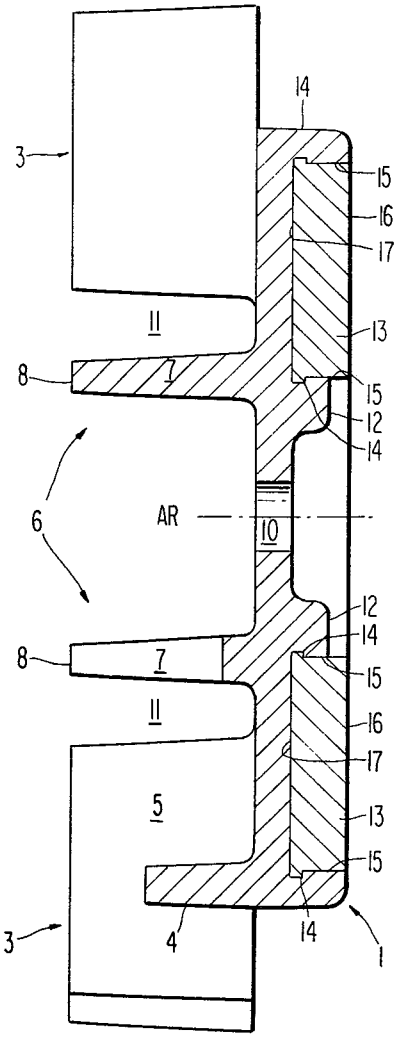
FIG. 2 is a sectional view of the wheel taken along line A—A in FIG. 1.
Figure 3:
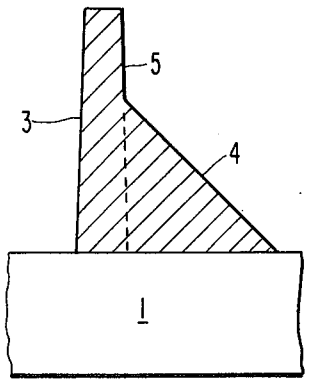
FIG. 3 is a detail view of a portion of a throwing blade mounted on the abrasive blast wheel.

With reference to FIG. 2, it will be apparent that the blades 3 extend in a direction away from the surface 2 of the wheel substantially parallel to the axis of rotation AR of the wheel. A web 4 of substantially triangular shape near the outer extremity of wheel 1 extends between rear surface 5 of blade 3 and surface 2 of wheel 1. Web 4 thereby provides support for throwing blade 5 and increases the mechanical strength of the device. The relationship between blade 3, wheel 1 and web 4 can be more readily observed by reference to FIG. 3.

Wheel 1 also includes an impeller generally designated as 6, and comprising a plurality of fingers 7 which extend away from surface 2 in a direction substantially parallel to the axis of rotation AR. The outermost ends 8 (FIG. 2) of each finger 7 are not connected to each other, thereby forming openings 9 between fingers 7. The impeller is intended to perform the conventional function of providing abrasive material to the throwing blades.

While abrasive blast wheels can be driven by means of a belt connected to a motor, direct connection to a motor shaft is the more common and preferred method. Therefore, a hole 10 is provided in wheel 1 for the insertion of a bolt, which is then inserted into the threaded opening in a motor shaft (not shown). The center of hole 10 is coincident with the axis of rotation AR.

As depicted in FIG. 1, the wheel 1, blades 3, webs 4 and impeller fingers 7 comprise a single piece. That is, each of these elements is not removable or separable from the other elements. If one of the elements becomes worn or damaged, the unitary structure is replaced with a similar structure. The one-piece abrasive blast wheel of this invention can be readily fabricated by casting from a suitable metal or metal alloy. In this way, the blades, webs, fingers and wheel can be formed into a unitary structure.

It will be seen in FIGS. 1 and 2 that the throwing blades 3 do not contact the fingers 7 of the impeller. Thus, there is a space 11 between each blade and the impeller. This space 11 is provided for the insertion of a conventional control cage (not shown) surrounding impeller 6 for the passage of abrasive material fed into the impeller 6 onto the blades 3. It will be understood that a conventional feed spout, cage retainer and cage adaptor can be employed for feeding the abrasive to the abrasive blast wheel. These parts are well known in the art. Suitable configurations for these parts are shown in U.S. Pat. No. 3,867,791, issued Feb. 25, 1975, but other configurations can also be employed.

Referring again to FIG. 2, it will be seen that the rear surface 12 of wheel 1 is provided with a cavity containing a metal ring 13. Ring 13 has a rotational axis that coincides with the axis of rotation AR of wheel 1. Ring 13 has an outer surface 16 and an inner surface 17. Inner surface 17 is of larger surface area than outer surface 16 thereby permitting the formation of circular flanges 14 that function as lugs for locking ring 13 in position on the back of wheel 1. This is made possible by flanges 14 interlocking with lug or circular flange means 15 provided on the rear surface 12 of wheel 1.

In the preferred embodiment of this invention, the one-piece abrasive blast wheel is formed by casting. This can be carried out using conventional casting techniques. For example, a pre-cut, unfinished ring of easily machinable metal of the type shown in the Figures is prepared. The ring is inserted in place in a casting mold, and molten metal is poured in the mold to form the wheel, blades, webs and fingers. This makes it possible to fabricate wheel 1, ring 13, blades 3, webs 4 and fingers 7 as a single piece. This unitary structure facilitates removal and replacement of worn or damaged parts, and because of the ease of fabrication, replacement can be economically performed.

An important feature of this invention is that the ring 13 mounted on the back of wheel 1 and the blades 3, webs 4 and fingers 7 mounted on the front of wheel 1, as well as wheel 1 per se, are comprised of dissimilar materials of construction. Since the wheel, blades, webs and fingers are exposed to abrasive material traveling at extremely high velocities, these elements of the device must be fabricated from an abrasion-resistant material. Otherwise, these elements will be subject to excessive wear. Preferably, the abrasion-resistant material is a hard, tough metal or metal alloy. Typical of suitable materials are metals and metal alloys having a Rockwell Hardness Number of about C45 to about C70, preferably about C60 to about C68. Particularly preferred are ferrous metals and metal alloys having Rockwell Hardness Numbers in these ranges, which are capable of being cast into the unitary structure comprising the wheel, blades, webs and fingers using conventional foundry casting techniques. Alloy 15-3 and Ni-hard are suitable metals.

As previously noted, the abrasive blast wheel is mounted on a conventional motor shaft. Mounting can be facilitated by the use of a conventional hub installed on the motor shaft by means of a conventional center taperlock bushing. The abrasive blast wheel can be secured to the hub, usually by means of bolts. It will be readily apparent that the rear surface of wheel 1 must be finished to interface with the hub. Because the wheel is fabricated from an abrasion-resistant material, the wheel is not readily machinable. Heretofore, it has been necessary to grind the rear surface of wheel 1 so that it can be adapted to the driving system comprising the motor and hub assembly. The motor and hub assembly are conventional in the art, and suitable apparatus is shown in the aforementioned U.S. Pat. No. 3,867,791.

This invention avoids this problem of finishing the rear surface of wheel 1 by grinding by providing that the ring 13 on the rear surface 12 of wheel 1 be comprised of a material that can be relatively easily worked with cutting tools. This makes it possible to use well-known machining techniques thereby avoiding the costly and timeconsuming grinding operation previously required. Typically, the machinable material can be a metal or metal alloy having a low Rockwell [C-scale] Hardness Number, such as near C20, which is the low end of the scale. Suitable machinable metals and metal alloys can also be selected based on Brinell Hardness Number. Typically, the ring can be fabricated from a metal or metal alloy having a Brinell Hardness Number of about 180 to about 235, preferably about 187 to about 229, especially about 195 to about 205. At substantially higher Brinell Hardness Numbers, such as 250 to 600, metals exhibit increasing abrasion resistance making them unsuitable for finishing by machining. Similarly, very soft metals and metal alloys should be avoided or excessive raking by the cutting tool will occur. Numerous metals and metal alloys are known for their relative ease of machinability. Among them is low carbon steel. Preferably, the ring 13 is comprised of a ferrous metal or metal alloy that can withstand degradation by the molten metal used to form, by casting, a unitary structure with wheel 1, blades 3, webs 4 and fingers 7.

Utilizing a readily machinable material for ring 13 substantially aids in balancing the abrasive blast wheel of this invention. Because this material of construction is machinable, it is possible to utilize a ring of sufficient mass to permit removing material from the ring, such as by drilling holes at suitable locations to remove plugs of metal, as required to balance the wheel. Also, it is possible to add weight to the ring by drilling holes and filling the holes with heavier metal, as needed, to balance the wheel. It is also possible to weld or otherwise secure weights to the ring as needed to balance the wheel.

This invention also makes it possible to chuck the unitary abrasive blast wheel in a conventional lathe, and then machine the surface of ring 13 with a cutting tool to thereby finish the ring to the close tolerances required to interface the wheel with a drive system for the wheel. Therefore, conventional tools can be used according to well-known techniques to finish the surfaces of the abrasive blast wheel and thereby facilitate their preparation for commercial use.

Furthermore, since the device of this invention comprises a unitary structure, the problems associated with blade removal and replacement are minimized. It is possible to economically replace the entire wheel, impeller and blade assembly in a single operation, because the device can be fabricated at low cost by casting suitable metals using conventional casting techniques.

Furthermore, because of the relatively soft metal insert in the rear surface of the abrasive blast wheel, it is possible to readily statically and dynamically balance the wheel. It will be readily apparent that machining of the surfaces of the wheel and balancing the wheel can be carried out in assembly-line fashion, further improving the economics of this system.

What is claimed is:

1. A blast wheel for rotatable, centrifugal abrasive blasting device comprising a wheel having a front surface and a rear surface;

a plurality of radially extending abrasive throwing blades on the front surface of said wheel, wherein said blades are substantially equally spaced around the circumference of said wheel;

a vaned impeller on the front surface of said wheel; and a ring rigidly secured to the rear surface of said wheel;

wherein said device is a one-piece casting formed of dissimilar materials, such that said wheel, said blades and said impeller are formed of an abrasion-resistant material having relatively poor machinability, and said ring is formed of a material having good machinability.

2. Blast wheel according to claim 1, wherein said impeller comprises a plurality of discrete fingers having openings therebetween, each finger extending in a direction substantially normal to the front surface of said wheel.

3. Blast wheel according to claim 2, wherein said abrasion-resistant material is a ferrous metal or metal alloy having a Rockwell Hardness Number of about C45 to about C70.

4. Blast wheel according to claims 2 or 3, wherein said material of good machinability is a ferrous metal or metal alloy having a Brinell Hardness Number of about 180 to about 235.

5. Blast wheel according to claim 2, wherein said abrasion-resistant material is a ferrous metal or metal alloy having a Rockwell Hardness Number of about C60 to about C68.

6. Blast wheel according to claims 2 or 5, wherein said material of good machinability is a ferrous metal or metal alloy having a Brinell Hardness Number of about 187 to about 229.

7. Blast wheel according to claims 2 or 5, wherein said material of good machinability is a ferrous metal or metal alloy having a Brinell Hardness Number of about 195 to about 205.

8. A blast wheel for a rotatable, centrifugal abrasive blasting device comprising a wheel having a front surface and a rear surface;

a plurality of radially extending abrasive throwing blades on the front surface of said wheel, wherein said blades are substantially equally spaced around the circumference of said wheel;

a vaned impeller on the front surface of said wheel; and a ring rigidly secured to the rear surface of said wheel; wherein said device is a one-piece casting formed of dissimilar materials, such that said wheel, said blades and said impeller are formed of an abrasion-resistant ferrous metal or metal alloy having a Rockwell Hardness Number of about C 45 to about C 70 and having relatively poor machinability, and said ring is formed of a ferrous metal or metal alloy having a Brinell Hardness Number of about 180 to about 235 and having good machinability.

* * * * *